United States Patent [19]

Bishop et al.

[11] Patent Number: 4,632,328

[45] Date of Patent: Dec. 30, 1986

[54] INFLATABLE MANDREL AND METHOD THEREFOR

[75] Inventors: Marshall E. Bishop, Richwood, W. Va.; Duane E. Thewlis, Norton, Ohio

[73] Assignee: The B. F. Goodrich Company, New York, N.Y.

[21] Appl. No.: 758,942

[22] Filed: Jul. 25, 1985

[51] Int. Cl.[4] ..... B65H 75/24

[52] U.S. Cl. ..... 242/72 B

[58] Field of Search ..... 242/72 B; 279/1 Q, 2 A; 269/48.1; 428/497, 475.8, 474.4, 483

[56] References Cited

U.S. PATENT DOCUMENTS

| | | | |
|---|---|---|---|
| 3,096,949 | 7/1963 | Huffman | 242/72 B |
| 3,139,242 | 6/1964 | Banlier | 242/72 B X |
| 3,295,188 | 1/1967 | Saueressig | 242/72 B X |
| 3,370,814 | 6/1966 | Kageorge et al. | 244/134 R |
| 3,394,902 | 7/1968 | Hise et al. | 242/72 B |
| 3,425,642 | 2/1969 | May | 242/72 B |
| 4,135,677 | 1/1979 | Warczak | 242/72 B |

FOREIGN PATENT DOCUMENTS

| | | | |
|---|---|---|---|
| 653299 | 12/1962 | Canada | 242/72 B |

*Primary Examiner*—Stuart S. Levy
*Assistant Examiner*—Joseph J. Hail, III
*Attorney, Agent, or Firm*—Woodrow W. Ban

[57] ABSTRACT

An inflatable mandrel supported upon a cylindrical surface, the cylindrical surface opposing a mandrel ply coated on only one surface with a rubberizing compound so that the obverse, uncoated mandrel ply surface opposes the cylindrical supporting surface. Such mandrels have utility in being easily removable from a building drum and easily installed upon a cylindrical support surface.

6 Claims, 1 Drawing Figure

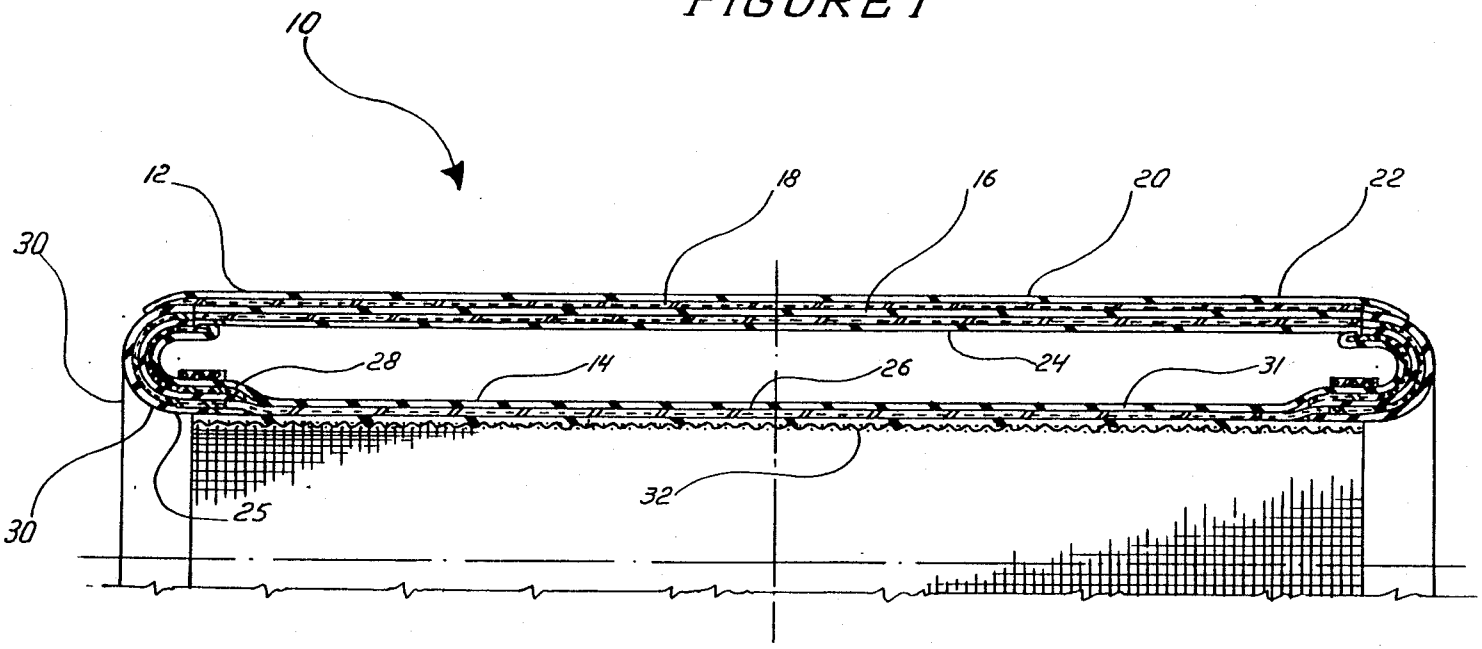
FIGURE I

INFLATABLE MANDREL AND METHOD THEREFOR

FIELD OF THE INVENTION

This invention relates to mandrels, and more particularly to inflatable mandrels suitable for engaging a surface of a cylindrical object and transmitting torque and/or lifting pressure between the surface of the cylindrical object and the second concentrically figured cylindrical object also engaged by the mandrel. Most particularly, this invention relates to the structure of such inflatable mandrels and to methods for their making.

BACKGROUND OF THE INVENTION

Mandrels are employed for bridging between generally cylindrical supporting structural surfaces and objects typically surrounding such structural surfaces for establishing engagement between the generally cylindrical structural surface and the object. For example, mandrels are used to bridge between a driving shaft and roll-like spools of paper being wound or unwound from a cylindrical tube generally surrounding the shaft. Where an inflatable mandrel is employed in bridging, the inflatable mandrel may be also employed to exert a pressure upon the surrounding object such as a cylindrical tube forming a part of a roll-like spool and may thereby lift the cylindrical tube centeringly about the generally cylindrical supporting structure and may be employed also to impart rotational motion from the cylindrical supporting shaft to the spool-like cylindrical tube.

Inflatable mandrels also can provide outwardly directed pressure against a surrounding object, and where the surrounding object is malleable or flexible, can cause the surrounding object to conform to contours of a second object surrounding the first.

Inflatable mandrels typically are formed by laying up fabric plies on a drum or cylinder to form one or more pairs of membranes that define an inflation chamber between individual membranes of the pairs. Typically the membranes are formed of laid-up fabric plies, both surfaces of each of the fabric plies having a rubberized coating applied thereover. The laid-up fabric plies are then vulcanized to form coherent, clearly defined membranes. Typically the cylinder drum on which the inflatable mandrels is built are of a collapsible nature, that is such drums can be distended for forming an inflatable mandrel and then collapsed slightly to facilitate removal of the formed inflatable mandrel therefrom.

Such collapsible building drums are generally expensive to purchase, and where it is desired that a mandrel of a substantial length, such as in excess of about ten feet, be built, purchase costs for collapsible building drums can become prohibitive, particularly where required for speciality inflatable mandrels where only a few units of a particular diameter are to be built. Where a mandrel building drum is not collapsible, removal of a long, finished mandrel from such a non-collapsible building drum can become a complicated, difficult matter. Typically, such formed inflatable mandrels are stretchable to a certain degree because of the rubbery characteristic necessary for desirable inflation properties, and pulling upon a formed mandrel to effect sliding removal from a building drum can cause a chinese handcuff effect functioning to seat the mandrel more firmly upon the building drum at a point where the mandrel stretches slightly during efforts to effect removal. Likewise, placing a completed mandrel upon a cylindrical supporting structural surface can be complicated by the same chinese handcuff effect.

A mandrel relatively easily removable from a building drum upon completion without necessitating the collapse of the building drum and relatively easily placed upon a generally cylindrical structural supporting surface for mandrel operations could find substantial utility in a variety of industries ranging from winding spools to pipe lining operations. Likewise, a method for forming such a readily removable/installable inflatable mandrel could find application in enhancing the mandrel manufacturing process.

SUMMARY OF THE INVENTION

The present invention provides an inflatable, tubular mandrel configured for support upon a cylindrical surface. The mandrel includes a pair of membranes defining an inflation chamber within the mandrel continuously surrounding the cylindrical surface. The membranes are formed of a plurality of coated fabric plies vulcanized or otherwise crosslinked to form unitary membranes of plies co-adhered by crosslinking.

One such membrane contacts the supporting cylindrical surface and includes a membrane surface directly in contact with the supporting cylindrical surface. This ply of the membrane directly contacting the supporting cylindrical surface is coated on only one surface and is uncoated on the obverse surface. This obverse surface directly opposes the supporting cylindrical surface.

In making an inflatable mandrel according to the method of the instant invention, wherein a surface of one membrane contacts the supporting cylindrical surface, the fabric ply coated on one surface only is applied and positioned to define the mandrel membrane surface contacting the supporting cylindrical surface. The fabric ply coated on only one surface is positioned so that the obverse uncoated surface directly opposes the supporting cylindrical surface.

The above and other features and advantages of the instant invention will become more apparent when considered in light of the drawing and a description of a preferred embodiment thereof that follow, together forming a part of the specification.

DESCRIPTION OF THE DRAWINGS

FIG. 1 is a schematic cross-sectional representation of a mandrel made in accordance with the instant invention.

BEST EMBODIMENT OF THE INVENTION

The present invention provides an inflatable mandrel readily removable both from any drum or cylindrical surface upon which the mandrel has been formed and also subject to ready installation and removal from cylindrical surfaces upon which the inflatable mandrel may be carried or supported in performing useful work.

A typical mandrel 10 in accordance with the invention is depicted in FIG. 1. Referring to FIG. 1, the mandrel 10 includes an upper membrane 12 and a lower membrane 14 each formed of individual plies.

In the upper membrane 12, plies 16, 18 are formed of a cord or fabric material, where a cord material typically oriented on a bias, and having a coating on each surface of the fabric. Typically this coating is a rubberizing or rubberized coating. By rubberized or rubberizing coating, what is meant is a rubber or elastomeric compound crosslinkable or vulcanizable to yield a cross-linked elastomeric coating upon the fabric that preferably penetrates interstices in the weave of the cord or above to firmly bind the cord or fabric to the coating. Such coated fabrics and cords of suitable or conventional nature for use in the practice of the invention are well known. The term fabric herein shall be understood to encompass cord materials. The plies 20, 22, 24 in FIG. 1 are gum layers utilized for providing a desirable finish upon surfaces of the mandrel and for bridging between the cord or fabric plies 18, 16. By gum what is meant is any suitable or conventional rubber or elastomer cross-linkable by vulcanization or otherwise with the coating on the plies 16, 18 to produce a unitary cross-linked elastomeric structure.

A lower membrane 14 includes a fabric ply 26 coated on both sides with a rubberizing compound. Typically the fabric ply 26 is configured to be comprised of rubberized cord configured in a straight cord as opposed to bias cord pattern. A plurality of bias cord plies 28 coated on both surfaces function to provide strength in zones of the mandrel 10 wherein a curvature is undertaken. A plurality of gum plies 30, 31 are positioned as in the upper membrane 12 to assist in co-adhering the fabric plies 28, 26 upon vulcanization and to provide a desirable surface finish to any final mandrel.

Particularly, the plies 24, 31 function to provide an interior mandrel surface having characteristics of substantial air non permeability.

A ply 32 is positioned within the lower membrane 14 opposing a surface of a building form or supporting cylindrical mandrel shaft (not shown) upon which the inflatable mandrel is supported, built or subsequently mounted for use. The ply 32 includes a rubberized coating only on a single surface thereof, this coating surface being oriented toward the gum layers 30 and the fabric layers 26, 28. The obverse surface of the ply 32 is uncoated with a rubberizing compound and consequently bare fabric of the ply 32 directly opposes the supporting surface of the building drum, or of the supporting cylinder of the mandrel. The fabric employed in the plies 18, 16, 26, 28 can be of any suitable or conventional material having utility in reinforcing mandrel structures of the instant invention, typically cording.

The fabric of the ply 32 should be a fabric having relatively "slippery" surface properties to facilitate sliding the completed mandrel off of the building drum and onto any supporting cylindrical surface for use. Weaves of polyamide, polyolefin, polyester materials, and particularly nylon find utility as the fabric for the ply 32. More particularly, fabrics having a weave structure conducive to a "non-stretch" performance such as square weaves find utility in the practice of the instant invention. In the practice of the instant invention, a fabric NS 268available from Reeves Brothers at Rutherfordton, N.C. and coated on one surface only with a rubberizing compound has been found to be particularly advantageous when employed for the ply 32.

Mandrels of the instant invention are built according to well known techniques with the fabric ply 32, coated on one surface only, being applied to the building drum with the uncoated surface thereof opposing the surface of the building drum upon which the mandrel is to be fabricated. The obverse rubberized surface of the ply 32 thereby opposes the rubberized fabric plies 6, 28 and the gum plies 30 of the lower member 14 as the mandrel is constructed.

The membranes 12, 14 as joined by the plies 28 and the gum layers 30 function to provide a torus-like inflation cavity 34 that can be inflated in any suitable or conventional manner to expand the outer surface of the inflatable mandrel 10 as represented by the gum layer 20 whereby the gum layer 20 encounters an outer surrounding surface (not shown) and engages the outer surrounding surface for lifting and/or imparting of motion thereto. It should be understood that the outer gum layer 20 could be replaced by a fabric ply coated on only one surface with the uncoated surface facing outwardly from the inflatable mandrel so as to oppose any surrounding outer surface. Further, it should be apparent that this outwardly facing fabric surface may be formed of a cover fiber material selected for providing desirable surface characteristics.

While a preferred embodiment has been shown and described in detail it should be apparent that various modifications may be made thereto without departing from the scope of the claims that follow.

What is claimed is:

1. In an inflatable tubular mandrel supported upon a cylindrical surface and having a pair of membranes defining an inflation chamber, the inflation chamber continuosly surrounding the cylindrical surface, one such membrane contacting the cylindrical surface, the membranes being formed of a plurality of plies coated on at least one surface with a rubberizing compound crosslinked to produce unitary membranes of crosslinkably co-adhered plies, one ply in the cylindrical surface contacting membrane having a surface in direct contact with the cylindrical surface, the improvement comprising: the direct contact ply being a fabric ply coated by the rubberizing compound on one surface only and being uncoated on an obverse surface, the uncoated obverse surface opposing the cylindrical surface.

2. The mandrel of claim 1, the direct contact ply coated on only one surface being a weave of a material selected from a group consisting of polyamide, polyester, polyolefin, and mixtures thereof.

3. The mandrel of claim 1, the direct contact ply coated on only one surface being nylon.

4. An inflatable, tubular mandrel for support upon a cylindrical surface, the mandrel comprising a pair of membranes each formed of at least one coated ply, the plies being crosslinked to form the coherent membranes, the membranes defining therebetween an inflation chamber surrounding the cylindrical surface, one of the membranes contacting the cylindrical surface and including a ply most adjacent the cylindrical surface, the adjacent ply being a fabric ply coated on only a single surface with a rubberizing compound, the uncoated surface thereof opposing in direct contact the cylindrical surface.

5. The mandrel of claim 4, the fabric ply coated on only a single surface being selected from a group consisting of polyamides, polyesters and polyolefins.

6. The mandrel of claim 4, the fabric ply coated on only a single surface being nylon.

* * * * *